United States Patent [19]

Limburg et al.

[11] 4,397,931

[45] Aug. 9, 1983

[54] STABILIZED ORGANIC LAYERED PHOTOCONDUCTIVE DEVICE

[75] Inventors: William W. Limburg, Penfield; Dale S. Renfer, Rochester; Damodar M. Pai, Fairport, all of N.Y.

[73] Assignee: Xerox Corporation, Stamford, Conn.

[21] Appl. No.: 383,672

[22] Filed: Jun. 1, 1982

[51] Int. Cl.[3] ..... G03G 5/14

[52] U.S. Cl. ..... 430/59; 430/58

[58] Field of Search ..... 430/58, 59, 66

[56] References Cited

U.S. PATENT DOCUMENTS

| | | | |
|---|---|---|---|
| 4,088,484 | 5/1978 | Okazaki et al. | 96/1.5 R |
| 4,232,103 | 11/1980 | Limburg et al. | 430/59 |
| 4,265,990 | 5/1981 | Stolka et al. | 430/59 |
| 4,293,630 | 10/1981 | Oka | 430/59 |
| 4,297,425 | 10/1981 | Pai et al. | 430/59 X |
| 4,315,982 | 2/1982 | Ishikawa et al. | 430/59 |
| 4,338,222 | 7/1982 | Limburg et al. | 430/59 X |

FOREIGN PATENT DOCUMENTS

| | | | |
|---|---|---|---|
| 55-88065 | 7/1980 | Japan | 430/59 |

*Primary Examiner*—Roland E. Martin, Jr.
*Attorney, Agent, or Firm*—E. O. Palazzo

[57] ABSTRACT

This invention is generally directed to an organic layered photoresponsive device containing a charge transport layer comprised of a composition of the following:

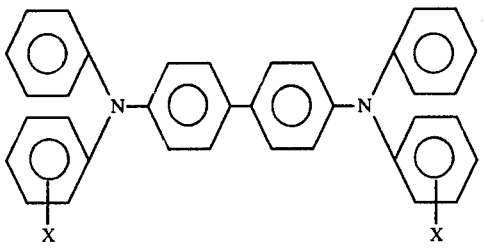

dispersed in a highly insulating and transparent organic resinous material, wherein x is selected from the group consisting of ortho ($CH_3$), meta ($CH_3$), para ($CH_3$), ortho (Cl), meta (Cl), and para (Cl), and dispersed in said transport layer from about 0.1 weight percent to about 10 weight percent of an additive composition selected from the group consisting of

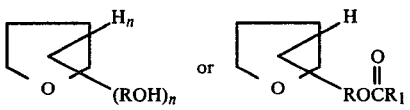

I.

wherein R and $R_1$ are independently selected from the group consisting of ethylene groups containing from about 1 to about 6 carbon atoms such as methylene, ethylene, propylene, butylene and the like, and n is 0 or 1;

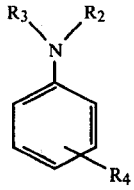

II.

wherein $R_2$ and $R_3$ are independently selected from alkyl groups containing from about 1 to about 6 carbon atoms, and $R_4$ is selected from the group consisting of alkyl groups containing from about 1 to about 6 carbon atoms, $CH_2OH$, $(CH_3)_2OH$, and

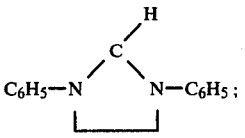

III.

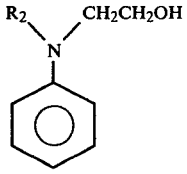

wherein $R_2$ is an alkyl group;

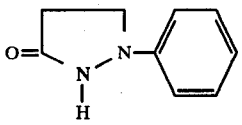

IV.

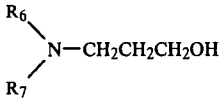

V.

wherein $R_6$ and $R_7$ are alkyl groups; and

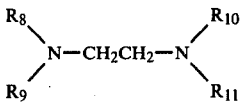

VI.

wherein $R_8$, $R_9$, $R_{10}$, and $R_{11}$ are alkyl groups.

18 Claims, No Drawings

STABILIZED ORGANIC LAYERED PHOTOCONDUCTIVE DEVICE

BACKGROUND OF THE INVENTION

This invention is generally directed to a layered organic photoconductive device containing therein certain additives. More specifically, the present invention is directed to stabilized layered photoconductive devices comprised of photogenerating layers and transport layers, wherein the transporting material is rendered non-conductive. The additives of the present invention when added to the transport layer prevent a condition known as cycle down, which results in causing the photoconductive device to discharge on repetitive use resulting in images of low quality or no images whatsoever. Imaging members containing the additives of the present invention are useful for causing the formation of uniform electrostatic latent images, wherein the undesirable bulk trapping of holes in the transport layer does not occur.

There is described in the prior art several layered organic photoresponsive devices, including flexible devices, which have particular utility in high speed imaging machines. One such device contains a support layer, a photogenerating layer and a charge transport layer as described in U.S. Pat. No. 4,265,990. Another layered photoresponsive device is comprised of a substrate, overcoated with a hole injecting layer, which in turn is overcoated with a transport layer, a photogenerating layer, and finally a top coating of an organic insulating resin, as described, for example, in U.S. Pat. No. 4,251,612. As photogenerating layers for these devices, there can be selected various photoconductive materials, including trigonal selenium, selenium alloys, such as selenium arsenic, selenium arsenic tellurium, metal, and metal-free phthalocyanines including x-metal-free phthalocyanines, copper phthalocyanines; vanadyl phthalocyanine, and the like.

The charge transport layer is generally comprised of an organic charge transport molecule dissolved in a polymeric matrix material, this layer being substantially non-absorbing in the spectral region of intended use, for example, visible light, while also being active in that the injection of photogenerated holes from the charge photogenerating layer can be accomplished, and further the hole transport layer allows the efficient transport of positive charges to the surface of the transport layer. Examples of charge transport layers include various diamines, dispersed in resinous binders.

Illustrative examples of hole injecting layers include materials such as gold, graphite, and preferably carbon or graphite dispersed in a polymeric material such as a polyester.

While the above described photoresponsive devices function effectively, prolonged usage causes the conductivity of these devices to increase, this increase apparently caused by the photoxidative instability of the materials utilized in the charge transport layer. Photoresponsive devices containing charge transport layers comprised of, for example, diamines, are subjected to various oxidizing species during their use, including ultra violet radiation, which causes the diamines to become conductive, particularly, after prolonged charging, exposure, and erasing of the photoconductive member. Conversion of the transport molecules to a conductive state by oxidizing species causes the gradual build up of dark conductivity with useage and leads to a phenonemon known as cycle down. In order to prevent short and long term increases in undesirable dark decay, it is therefore important that the transport layer molecules be rendered insulating throughout numerous imaging cycles.

In accordance with the present invention, the transport layer molecules are converted to an insulating species by adding to the transport layer various stabilizers or additives, which transfer electrons to the conductive species contained in the transport layer material, and return this material to its non-conducting state. These stabilizers tend to prevent ultra violet degradation, and further are selected so as not to introduce hole traps of their own under cyclic use, since this can result in a cumulative trapping resulting in a residual build up or cycle up which is not desired. This trapping can be an isolated electronic state of the additive, or could result from the additive changing the character of the dispersion of the host molecule in the binder matrix.

The selection of diamine compositions as transporting layers for photoresponsive devices has been a recent development, thus, very little effort has been devoted to a study of these substances, particularly, as these studies apply to the production of latent electrostatic images over extended periods of time. Although it is not desired to be limited by theory, it is believed that the diamine charge transport molecules can be converted to an undesirable conducting state after a short period of time, thereby adversely affecting image quality. Accordingly, there is a need for compositions and processes whereby the charge transport diamine materials will remain in an insulating state throughout numerous imaging cycles.

OBJECTS OF THE INVENTION

It is an object of the present invention to provide layered photoconductive imaging devices wherein the bulk trapping of holes does not occur in the charge transport layer.

In a further object of the present invention there is provided a charge transport layer which remains insulating throughout numerous imaging cycles.

In yet another object of the present invention, there is provided the use of stabilizing materials or additives in the charge transport layer for the purpose of transporting electrons to the diamine transport material, causing the conducting diamine to be converted to an insulating diamine.

An additional object of the present invention resides in a layered photoconductive imaging device containing stabilizing additives in the charge transport layer, for the purpose of preventing oxidizing species from adversely affecting such devices.

These and other objects of the present invention are accomplished by providing an improved layer photoconductive imaging device containing a transport layer comprised of molecules of the formula:

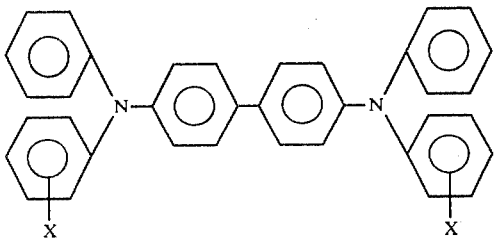

dispersed in a highly insulating and transparent organic resinous material, wherein x is selected from the group consisting of ortho ($CH_3$), meta ($CH_3$), para ($CH_3$), ortho (Cl), meta (Cl), and para (Cl), and a stabilizer or additive selected from the group consisting of those materials of the following formula:

I.

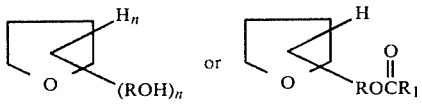

wherein R and $R_1$ are independently selected from the group consisting of ethylene groups containing from about 1 to about 6 carbon atoms such as methylene, ethylene, propylene, butylene and the like, and n is 0 or 1;

II.

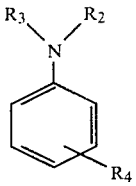

where $R_2$ and $R_3$ are independently selected from alkyl groups containing from about 1 to about 6 carbon atoms such as methyl, ethyl, propyl, butyl, pentyl, hexyl and the like, with methyl and ethyl the preferred, and $R_4$ is selected from the group consisting of alkyl groups containing from about 1 to about 6 carbon atoms, $CH_2OH$,$(CH_3)_2OH$, and

III.

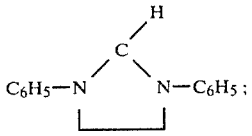

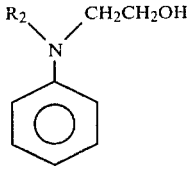

wherein $R_2$ is an alkyl group as defined herein;

IV.

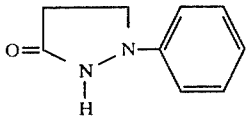

-continued

V.

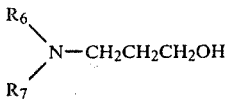

wherein $R_6$ and $R_7$ are alkyl groups as defined herein; and

VI.

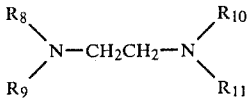

wherein $R_8$,$R_9$, $R_{10}$, and $R_{11}$ are alkyl groups as defined herein.

Also embraced within the present invention are layered photoconductive devices containing the charge transport layer of the present invention. Examples of illustrative overcoated photoconductive devices include those comprised of a substrate, a photogenerating layer, and a transport layer containing the stabilizers or additives of the present invention. In these devices, the photogenerating layer may be coated on the substrate or alternatively, the transport layer may be deposited on the substrate and the photogenerating layer deposited on the transport layer. These devices are described in U.S. Pat. No. 4,265,990, the disclosure of which is totally incorporated herein by reference.

The substrate for these devices may be opaque or substantially transparent and may comprise any suitable material having the requisite mechanical properties. The substrate may comprise a layer of non-conducting material such as an inorganic or organic polymeric material; a layer of an organic or inorganic material having a conductive surface layer arranged thereon or a conductive material such as, for example, aluminum, brass or the like. The substrate may be flexible or rigid and may have any of many different configurations such as, for example, a plate, a cylindrical drum, a scroll, an endless flexible belt, and the like. Preferably, the substrate is in the form of an endless flexible belt.

The thickness of the substrate layer depends on many factors, including economic considerations, and this layer may be of substantial thickness, for example, over 100 mils. or minimum thickness providing there are no adverse effects on the system. In one preferred embodiment this thickness ranges from about 3 mils. to about 10 mils.

The photoconductive charge carrier generating layer may comprise various suitable photoconductive charge carrier generating materials known for use in electrophotography, provided they are electronically compatible with the charge carrier transport layer, and charge carriers can travel in both directions across the interface between the two layers. Particularly preferred photoconductive charge carrier generating materials include amorphous and trigonal selenium, selenium-arsenic, and selenium-tellurium alloys, and organic charge carrier generating materials such as phthalocyanines, including metal free, for example the x-form of phthalocyanine, or metal phthalocyanines including vanadyl phthalocyanine. These materials can be used alone or as a dispersion in a polymeric binder. Generally, it is desired to provide this layer in a thickness which is sufficient to absorb at least 70 percent (or more) of the incident radiation which is directed upon it in the imagewise exposure step. The maximum thickness is dependent primarily on factors such as mechanical considerations, e.g. whether a flexible photoreceptor is desired. The layer, however, is typically from about 0.5 to about 10 microns or more in thickness.

The charge transport layer comprised of the diamine molecules mentioned herein dispersed in a highly insulating and transparent organic resinous material is substantially non-absorbing in the spectral region of intended use, that is visible light, but is active in that it allows injection of photogenerated holes from the injecting interface. The highly insulating resin, becomes electrically active when it contains from about 10 to 75 weight percent of the substituteed N,N,N',N'-tetraphenyl[1,1'-bisphenyl]4-4'diamines corresponding to the foregoing formula. Compounds corresponding to this formula include, for example, N,N'-diphenyl-N,N'-bis(alkylphenyl)-[1,1-biphenyl]-4,4'-diamine wherein the alkyl is selected from the group consisting of methyl such as 2-methyl, 3-methyl and 4-methyl, ethyl, propyl, butyl, hexyl and the like. In the case of chloro substitution, the compound is named N,N'-diphenyl-N,N'-bis (halo phenyl)-[1,1'-biphenyl]-4,4'-diamine wherein the halo atom is 2-chloro, 3-chloro or 4-chloro.

Other electrically active small molecules which can be dispersed in the electrically inactive resin to form a layer which will transport holes include bis(4-diethylamino-2-methylphenyl) phenylmethane; p-diethylaminobenzaldehyde-(diphenyl hydrazone), 2,5-bis(4-N,N'-diethylaminophenyl)-1,3,4-oxadiazole; bis(4-diethylaminophenyl) phenylmethane.

The transport layer may contain any transparent electrically inactive binder resinous material such as those described by Middleton et al in U.S. Pat. No. 3,121,006, incorporated herein by reference. The resinous binder contains from 10 to 75 weight percent of the active material corresponding to the foregoing formula and preferably from about 30 to about 50 weight percent of this material. Typical organic resinous materials useful as the binder include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight ($M_w$) of from about 20,000 to about 100,000 with a molecular weight in the range of from about 50,000 to about 100,000 being particularly preferred.

The charge transport layer has dispersed therein from about 0.1 weight percent to about 10 weight percent and preferably from about 0.1 weight percent to about 3 weight percent of the stabilizers or additives described hereinbefore. Illustrative specific examples of these stabilizers include tetrahydrofurane, 4-N,N-diethylcumidine, N,N-diethyl-p-toluidine, 4-diethyl amino phenylcarbinol, N-ethyl-N(β-hydroxyethyl) aniline, 1-phenyl-3-pyrazolidone, diethylamino-pyridine, N,N-dimethyl-m-toluidine, N,N-dimethyl-p-toluidine, 3-N,N-diethyl propanolamine, tetramethyl ethylene diamine, tetrahydrofurfuryl oleate, tetrahydrofurfuryl alcohol, 2-(4'-diethylaminophenyl)-1,3-diphenylimidazolidone, and the like.

While it is not desired to be limited by theory, it is believed that the stabilizers or additives of the present invention, when dispersed in the charge transport layer containing a diamine, transfer electrons to the diamine cation radical formed as a result of oxidation, wherein the electrons donated neutralize the positive charge contained on the cation. More specifically, it is believed that the following is occurring as exemplified with diethyl cumidine

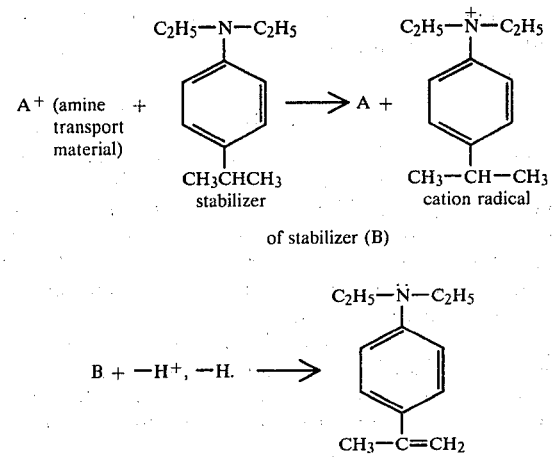

While illustrative examples of various stabilizers and/or additives have been recited herein, other materials may be useful providing they readily transfer electrons to the diamine transport material and do not adversely affect the imaging member. Further, such additives should not themselves modify the electrical properties of the transport layer material or of the other layers present in the photoresponsive device. Additionally, when selecting the stabilizers and additives for preventing oxidation, it is important that these materials do not introduce conducting states in the layer as a result of their chemical action, therefore, materials such as classical anti-oxidants including hydroquinone and butylated hydroxytoluene, would not be useful.

Additionally, the stabilizer materials of the present invention are selected so as to not react with other components in the photoconductor device. Thus, for example, while the stabilizers 3-N,N-diethylpropanolamine and tetramethylethylene diamine, stabilize the amine transport compositions mentioned hereinbefore, these stabilizers would not functon as effectively when the amine transport molecule is dispersed in the polycarbonate resinous binder since these stabilizers have a tendency to cause degradation of the polycarbonate binder.

The photoconductive layered imaging members of the present invention, and more specifically, the photoconductive devices containing a charge transport layer comprised of a diamine dispersed in a resinous binder containing the stabilizers and additives of the present invention, can be utilized as imaging members in xerographic imaging systems. The members thus selected for causing the formation and development of latent electrostatic images are as described, for example, in U.S. Pat. No. 4,265,990.

The additives of the present invention as illustrated in the working examples accomplish a number of objectives including quenching (eliminating) the cation radical of the transport molecule, thus preventing a conductivity increase in the layers containing such molecules and preventing conductivity increases of transport layers exposed to ultraviolet radiation. Also the additives themselves do not introduce any charge carrier traps into the layers involved since this would cause a degradation in the performance of the photoresponsive device.

The following examples further specifically define the present invention, it being understood that these examples are intended to be illustrative only. The invention is not intended to be limited to the materials, conditions, processes, parameters, recited therein. All parts and percentages are by weight unless otherwise indicated.

EXAMPLE I

This example illustrates the necessity for stabilizing transport layers containing N,N'-diphenyl-N,N'-bis(3-methylphenyl)-[1,1'-biphenyl]-4,4'-diamine dispersed in a polycarbonate selected for use in an atmosphere containing oxidative effluents, and ultra violet radiation such as those that occur in imaging apparatuses employing corona charging devices.

There is dissolved in 3 milliliters of methylene chloride 0.3 grams of a polycarbonate resin commercially available as Makrolon ®, and 0.2 grams of N,N'-diphenyl-N,N'-bis(3-methylphenyl)-[1,1'-biphenyl]-4,4'-diamine.

The above solution is then formed into a film of a thickness of about 25 microns with a draw bar, by coating on ball grained aluminum, and vacuum drying at 40° C. for 16 hours.

The film is then xerographically tested as follows.

The film is corona charged to a negative potential of 1,800 volts and the dark decay is monitored for 5 seconds with an electrical probe. Neglibile dark decay is observed in that the film contained essentially about 1,600 volts as measured by an electrical probe.

The film is then exposed to an intense ultra violet radiation source, total exposure, $10^{16}$ photons, and tested xerographically in accordance with the above process. Measurement of the dark decay of this device with an electrical probe showed a significant drop from 1,800 volts to 500 volts, a decrease of 1,300 volts, indicating the film is conductive.

To determine the effect of oxidation, films containing the cation radical of N,N'-diphenyl-N,N'-bis(3-methylphenyl)-[1,1'-biphenyl]-4,4'-diamine are prepared as follows.

0.3 grams of Makrolon ® polycarbonate, 0.2 grams of N,N'-diphenyl-N,N'-bis(3-methylphenyl)-[1,1'-biphenyl]-4,4'-diamine, and 2 micrograms of the cation radical of the above diamine are dissolved in 3 milliliters of methylene chloride. An approximately 25 micron thick layer of this material is coated on ball grained aluminum and is vacuum dried at 40° C. for 16 hours, followed by exposure of this film to oxygen.

The dark decay of this film composition subsequent to negative charging is over 1,000 volts in 0.5 seconds, and 1,300 volts in 5 seconds, as determined by an electrical probe. Thus, this layer is also conductive when exposed to an oxidizing effluents.

The above cation radical of the diamine is prepared as follows.

tris(p-bromophenyl) ammoniumyl hexchloroantimonate, 9.56 milligrams, $1.17\times10^{-5}$ mole, and 60.4 milligrams, $1.17\times10^{-4}$ moles of N,N'-diphenyl-N,N'-bis(3-methylphenyl)-[1,1-biphenyl]-4,4'-diamine, are dissolved in 1,000 milliliters of methylene chloride. A 0.2 milliliter portion or aliquot of this solution contains 2 micrograms of the amine cation. Aliquots from this solution are selected for use in the working examples illustrated herein.

EXAMPLE II

A. 0.3 grams of Makrolon ® polycarbonate, 0.2 grams of N,N'-diphenyl-N,N'-bis(3-methylphenyl)-[1,1'-biphenyl]-4,4'-diamine, 2 micrograms of the cation radical of the diamine and 0.02 grams of N,N-diethyl cumidine additive are dissolved in 3 milliliters of methylene chloride. An approximately 25 micron thick film of this mixture is coated on ball grained aluminum, and this material is vacuum dried at 40° C. for 16 hours. The film is then xerographically tested in accordance with the procedure of Example I and the dark decay compared to the film of Example I containing no additive. The dark decay is about 200 volts as measured by an electrical probe, which is significantly less than the film containing no additive.

B. 0.3 grams of Makrolon ® polycarbonate, 0.2 grams of N,N'-diphenyl-N,N'-bis(3-methylphenyl)-[1,1'-biphenyl]-4,4'-diamine and 0.02 grams of N,N-diethyl cumidine additive are dissolved in 3 milliliters of methylene chloride. A 25 micron thick film of this mixture is coated on ball grained aluminum and dried at 40° C. for 16 hours. The film is then xerographically tested before and after subjecting it to a ultra violet source (corona charging device). The dark decay measured with the film of Example I (no additive) is substantially eliminated.

C. A layered photoconductive device is then fabricated by vapor depositing a 0.5 micron thick charge generating layer of amorphous selenium on an aluminum substrate, which had been coated with a thin adhesive/blocking layer of duPont 49,000 polyester ®. There is then coated on the generating layer, a layer 25 microns in thickness, as prepared in Example II, B, and the resulting device is vacuum dried at 40° C. for 16 hours. The device is negatively charged and is exposed to a light source. Subsequently, the discharge rate of this device is measured with an electrical probe. The discharge rate is the same as that observed in a control device comprised of the same layers but containing no additive. Also on repetitive xerographic cycling, charge, expose, erase, there was no residual build up indicating that the additive by its presence does not introduce any charge traps that create residual potential.

EXAMPLE III

The three experiments of Example II are repeated with the exception that the additive 4-diethylaminopyridine is selected in place of the additive N,N-diethylcumidine, and substantially similar results are obtained.

EXAMPLE IV

The three experiments of Example II are repeated with the exception that the additive N,N-diethyl-p-toluidine is selected in place of N,N-diethyl cumidine and substantially similar results are obtained.

EXAMPLE V

The three experiments of Example II are repeated with the exception that the additive N,N-diethyl-m-toluidine is selected in place of the additive N,N-diethyl cumidine and substantially similar results are obtained.

Although the invention has been described with respect to specific preferred embodiments, it is not intended to be limited thereto, rather those skilled in the art will recognize variations and modifications can be accomplished therein which are within the spirit and scope of the present invention.

We claim:

1. A stabilized organic layered photoresponsive device comprised of a substrate, a photogenerating layer and a charge transport layer in contact with the photogenerating layer, the charge transport layer being comprised of a composition of the following formula:

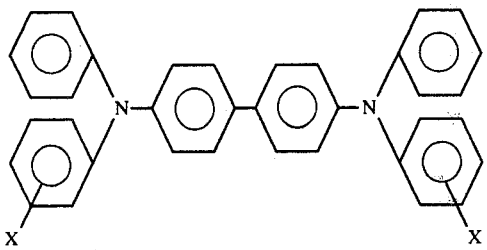

dispersed in a highly insulating and transparent organic resinous material, wherein x is selected from the group consisting of ortho ($CH_3$), meta ($CH_3$), para ($CH_3$), ortho (Cl), meta (Cl), and para (Cl), and dispersed in said transport layer from about 0.1 weight percent to about 10 weight percent of an additive composition selected from the group consisting of

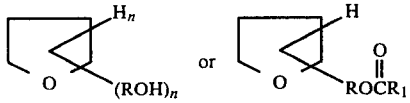

I.

wherein R and $R_1$ are independently selected from the group consisting of ethylene groups containing from about 1 to about 6 carbon atoms, and n is 0 or 1;

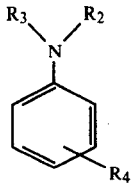

II.

wherein $R_2$ and $R_3$ are independently selected from alkyl groups containing from about 1 to about 6 carbon atoms, and $R_4$ is selected from the group consisting of alkyl groups containing from about 1 to about 6 carbon atoms, $CH_2OH$, $(CH_3)_2OH$, and

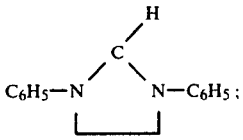

III.

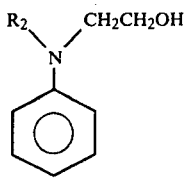

wherein $R_2$ is an alkyl group;

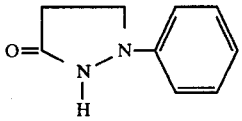

IV.

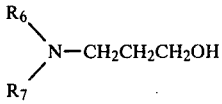

V.

wherein $R_6$ and $R_7$ are alkyl groups; and

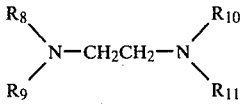

VI.

wherein $R_8$, $R_9$, $R_{10}$, and $R_{11}$ are alkyl groups.

2. A device in accordance with claim 1 wherein the charge transport composition is N,N'-diphenyl-N,N'-bis(3-methylphenyl)-[1,1'-biphenyl]-4,4'-diamine.

3. A device in accordance with claim 1 wherein the resinous binder is a polycarbonate resin present in an amount of from about 25 percent by weight to about 90 percent by weight.

4. A device in accordance with claim 1 wherein the additive is tetrahydrofuran.

5. A device in accordance with claim 1 wherein the additive is 4-N,N-diethylcumidine.

6. A device in accordance with claim 1 wherein the additive is N,N-diethyl-p-toluidine.

7. A device in accordance with claim 1 wherein the additive is 4-diethylamino phenylcarbinol.

8. A device in accordance with claim 1 wherein the additive is N-ethyl-N(β-hydroxyethyl)aniline.

9. A device in accordance with claim 1 wherein the additive is 1-phenyl-3-pyrazolidone.

10. A device in accordance with claim 1 wherein the additive is N,N-dimethyl-m-toluidine.

11. A device in accordance with claim 1 wherein the additive is N,N-dimethyl-p-toluidine.

12. A device in accordance with claim 1 wherein the additive is 3-N,N-diethyl propanolamine.

13. A device in accordance with claim 1 wherein the additive is tetramethylethylene diamine.

14. A device in accordance with claim 1 wherein the additive is tetrahydrofurfuryl oleate.

15. A device in accordance with claim 1 wherein the additive is tetrahydrofurfuryl alcohol.

16. A device in accordance with claim 1 wherrein the additive is 2-(4'-diethylaminophenyl)-1,3-diphenylimidazolidone.

17. An imaging member in accordance with claim 1 wherein the photogenerating layer is trigonal or vanadyl phthalocyanine, the substrate is aluminum and the charge transport layer is N,N'-diphenyl-N,N'-bis(3-methylphenyl)-[1,1'-phenyl]-4,4'-diamine.

18. An organic layered photoconductive imaging device in accordance with claim 1 wherein the additive is tetrahydrofurane, 4-N,N-diethylcumidine, N,N-diethyl-p-toluidine, 4-diethyl amino phenylcarbinol, N-ethyl-N(β-hydroxyethyl) aniline, 1-phenyl-3-pyrazolidone, N,N-dimethyl-m-toluidine, N,N-dimethyl-p-toluidine, 3-N,N-diethyl propanolamine, tetramethyl ethylene diamine, tetrahydrofurfuryl oleate, tetrahydrofurfuryl alcohol, or 2,-(4'-diethylaminephenyl)-1,3-diphenylimidazolidone.

* * * * *